US009786464B2

(12) United States Patent
Lunin et al.

(10) Patent No.: US 9,786,464 B2
(45) Date of Patent: Oct. 10, 2017

(54) SUPERCONDUCTING MULTI-CELL TRAPPED MODE DEFLECTING CAVITY

(71) Applicant: Fermi Research Alliance, LLC, Batavia, IL (US)

(72) Inventors: Andrei Lunin, Geneva, IL (US); Timergali Khabiboulline, Geneva, IL (US); Ivan Gonin, Sugar Grove, IL (US); Vyacheslav Yakovlev, Batavia, IL (US); Alexander Zholents, Darien, IL (US)

(73) Assignee: Fermi Research Alliance, LLC, Batavia, IL (US)

( * ) Notice: Subject to any disclaimer, the term of this patent is extended or adjusted under 35 U.S.C. 154(b) by 154 days.

(21) Appl. No.: 14/813,811

(22) Filed: Jul. 30, 2015

(65) Prior Publication Data

US 2016/0035531 A1 Feb. 4, 2016

Related U.S. Application Data

(60) Provisional application No. 62/030,680, filed on Jul. 30, 2014, provisional application No. 62/037,316, filed on Aug. 14, 2014.

(51) Int. Cl.

| | |
|---|---|
| ***H01J 23/20*** | (2006.01) |
| ***H01J 25/78*** | (2006.01) |
| ***H01P 7/06*** | (2006.01) |
| *H01P 1/162* | (2006.01) |
| *H01P 5/08* | (2006.01) |

(52) U.S. Cl.
CPC ..... *H01J 23/20* (2013.01); *H01J 25/78* (2013.01); *H01P 7/06* (2013.01); *H01P 1/162* (2013.01); *H01P 5/082* (2013.01)

(58) Field of Classification Search
CPC ... H01J 23/20; H01J 25/78; H01P 7/06; H01P 5/082; H01P 1/162
USPC ..... 250/396 R, 396 ML; 335/216
See application file for complete search history.

(56) References Cited

U.S. PATENT DOCUMENTS 5,315,210 A * 5/1994 Lien ..... H01J 23/20 315/5.39
7,884,333 B2 2/2011 Delayen

OTHER PUBLICATIONS

Zholents, A. et al., "Generation of Subpicosecond X-ray Pulses Using RF Orbit Deflection," Nuclear Instruments and Methods in Physics Research (1999) Section A, 425:385-389.

* cited by examiner

*Primary Examiner* — Michael Maskell
(74) *Attorney, Agent, or Firm* — Kevin Soules; Luis M. Ortiz; Kermit D. Lopez

(57) ABSTRACT

A method and system for beam deflection. The method and system for beam deflection comprises a compact superconducting RF cavity further comprising a waveguide comprising an open ended resonator volume configured to operate as a trapped dipole mode; a plurality of cells configured to provide a high operating gradient; at least two pairs of protrusions configured for lowering surface electric and magnetic fields; and a main power coupler positioned to optimize necessary coupling for an operating mode and damping lower dipole modes simultaneously.

15 Claims, 9 Drawing Sheets

SUPERCONDUCTING MULTI-CELL TRAPPED MODE DEFLECTING CAVITY

CROSS REFERENCE TO RELATED PATENT APPLICATIONS

This patent application claims the priority and benefit of U.S. provisional patent application 62/030,680 entitled "Superconducting Multi-Cell Trapped Mode Deflecting Cavity", filed on Jul. 30, 2014. This patent application also claims the priority and benefit of U.S. provisional patent application 62/037,316 entitled "Superconducting Multi-Cell Trapped Mode Deflecting Cavity", filed on Aug. 14, 2014. This patent application therefore claims priority to U.S. Provisional Patent Application Ser. No. 62/030,680 which is incorporated herein by reference in its entirety and also claims priority to U.S. Provisional Patent Application Ser. No. 62/037,316 which is incorporated herein by reference in its entirety.

STATEMENT OF GOVERNMENT RIGHTS

This invention was made with government support under the Fermi Research Alliance, contract no. DE-AC02-07CH11359 awarded by the Department of Energy. The government has certain rights in the invention.

TECHNICAL FIELD

The present invention is related to methods and systems for beam deflection. In particular, the invention is related to a superconducting Quasi-waveguide Multi-cell Resonator (QMiR) for beam deflection in Short Pulse X-ray (SPX) projects.

BACKGROUND

Radio frequency deflecting cavities are widely used in particle accelerators for beam manipulations. Superconducting structures extend the application areas of such devices to high duty factor and large beam current regimes, providing efficient and high gradient operations simultaneously. However, superconductivity adds complexity to the design of radio frequency (RF) cavities because of limitations associated with the maximum allowable surface magnetic field.

Alternative solutions based on the transverse TE11 magnetic mode and TEM lines have been proposed for the deflection of charged particles. Such approaches may result in smaller cavity design compared to the conventional TM11 elliptical cavity and eliminate the presence of LOM modes. However, these new designs are still comprised of a closed resonant volume with a dense eigenfrequency spectrum, and therefore require auxiliary couplers for damping coherent high order mode excitation.

Pill-box type resonators with an elliptical shape, operating in the dipole electric TM11 mode, have been used for beam deflection. Despite its simple geometry and good surface cleaning capability, there are a few major drawbacks to such designs. First, the TM11 mode is not the lowest mode in the cavity spectrum. Additionally, a number of Low Order Modes (LOM) and High Order Mode (HOM) couplers are required for damping unwanted resonances. Further, such cavities have large transverse dimensions. Thus, there are difficulties with the cryostat design, which complicates cavity operation. Thus, there is a need for a simple and compact superconducting structure for beam manipulation applications.

BRIEF SUMMARY

The embodiments disclosed herein describe methods and systems for deflecting a beam. A resonator is inserted into a beam line, which may be a beam of particles, and is attached to a waveguide system and an external radio frequency (RF) source. In order to produce a deflecting voltage, a QMiR can provide a few kW (kilo Watts) of continuous RF power depending on actual beam parameters.

The deflecting resonator, or "cavity," has a high operating gradient and efficient HOM damping. Avoiding complicated HOM couplers simplifies the mechanical design of the present embodiments and allows the cavity to fit in a compact cryostat vessel.

The aforementioned aspects and other objectives and advantages can now be achieved as described herein. A method and system associated with an RF cavity for beam deflection comprises: a wave guide comprising an open ended resonator volume configured to operate as a trapped dipole mode; a plurality of cells configured to provide a high operating gradient; and at least two pairs of protrusions configured for lowering surface electric and magnetic fields. The RF cavity further comprises a compact superconducting RF cavity. The RF cavity further comprises high order monopole modes wherein the higher order monopole modes are damped by radiating to open beam line pipes. In another embodiment, the RF cavity further comprises a main power coupler positioned to optimize necessary coupling for an operating mode and damping lower dipole modes simultaneously. The least two pairs of protrusions are elliptical shaped. The plurality of cells comprises electrodes formed in opposite walls of the resonator. The RF cavity further comprises a beam of particles configured to pass through the open-ended resonator. The RF cavity further includes a broadband coaxial antenna configured as an EM-field pick-up probe. A capacitive diaphragm may also be configured to control power coupling ratio associated with the RF cavity.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1:
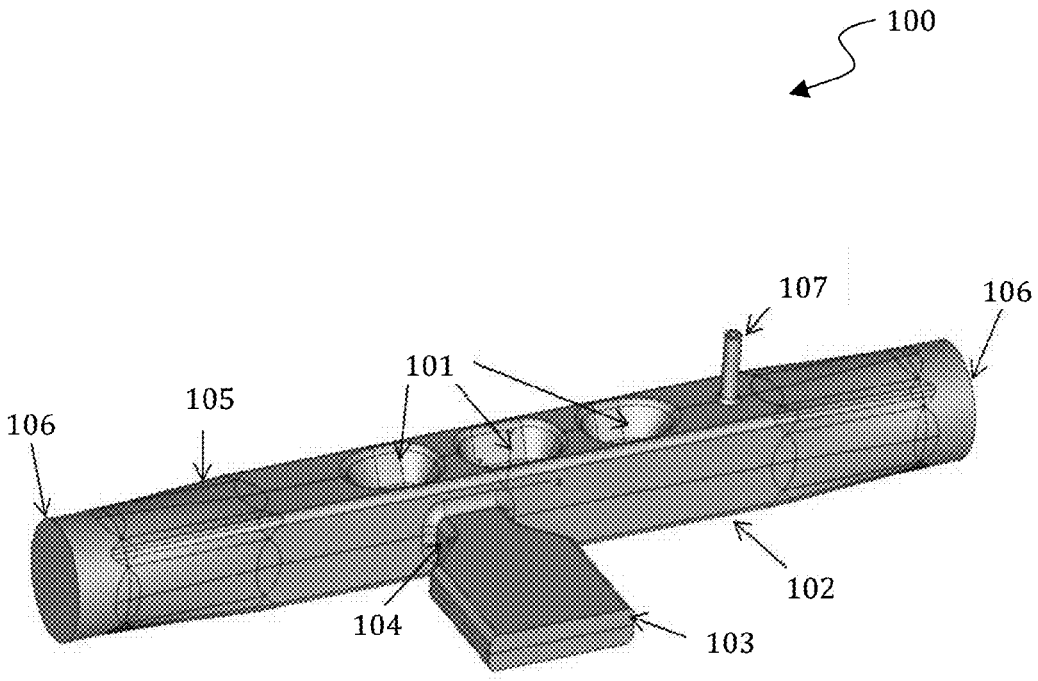
FIG. 1 depicts a perspective view of a deflecting superconducting cavity in accordance with the disclosed embodiments.

The particular values and configurations discussed in these non-limiting examples can be varied and are cited merely to illustrate at least one embodiment and are not intended to limit the scope thereof. The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments disclosed herein describe methods, systems, and apparatuses associated with transverse deflecting cavities which are required for various accelerator applications, in particular, those that require transversely kicking charged particles. The transverse deflecting cavities disclosed herein have a wide range of possible applications including, but not limited to, use in light sources applications, RF separators, and crab cavities for colliders. They may also be used in RF-based bunch length diagnostics.

For purposes of illustration, the present embodiments relate to, and otherwise describe, a microwave superconducting resonator for use in particle accelerators, and more specifically relate to an improved design for deflecting cavities for use in high current and high duty factor applications. This embodiment is exemplary and does not limit the potential use of the invention in various other applications as described above.

The present embodiments use multiple electrodes integrated in a waveguide to form a trapped mode resonator. The transverse EM-field components of the trapped dipole mode can be used to create a kick that effectively deflects charged particles that are passing through the cavity in a beam. The cavity can be open (i.e., has no end walls) to the beam line(s). This helps to significantly reduce the maximum quality factors of High Order Modes and, thus, to avoid complicated HOM couplers and to simplify the cavity's mechanical design. Embodiments disclosed herein provide a high transverse kick, have a minimum number of auxiliary couplers, and can operate with high beam current.

FIG. 1 illustrates a view of an apparatus 100 including a three-cell TE mode deflecting superconducting cavity in accordance with one embodiment. It should be appreciated that the present embodiments may include any arrangement of two or more cells 200. Additionally, in accordance with the embodiments described herein the cavity geometry can be scaled to operate with an arbitrary frequency between approximately 1 GHz to 30 GHz. This value is limited by the practical size of the beam line.

The cells can be understood as a geometrical period associated with the cavity and composed of a pair of smooth protrusions, or electrodes, in opposite walls of a waveguide 102. The waveguide 102 is preferably square because the square shape allows for minimization of the transverse space occupied by the cavity while simultaneously providing a simple mechanical design. The waveguide 102 may, however, be formed with an arbitrary cross-section including, but not limited to, a rectangular, circular, or elliptical form, all of which are possible choices depending on design consideration.

Figure 2:
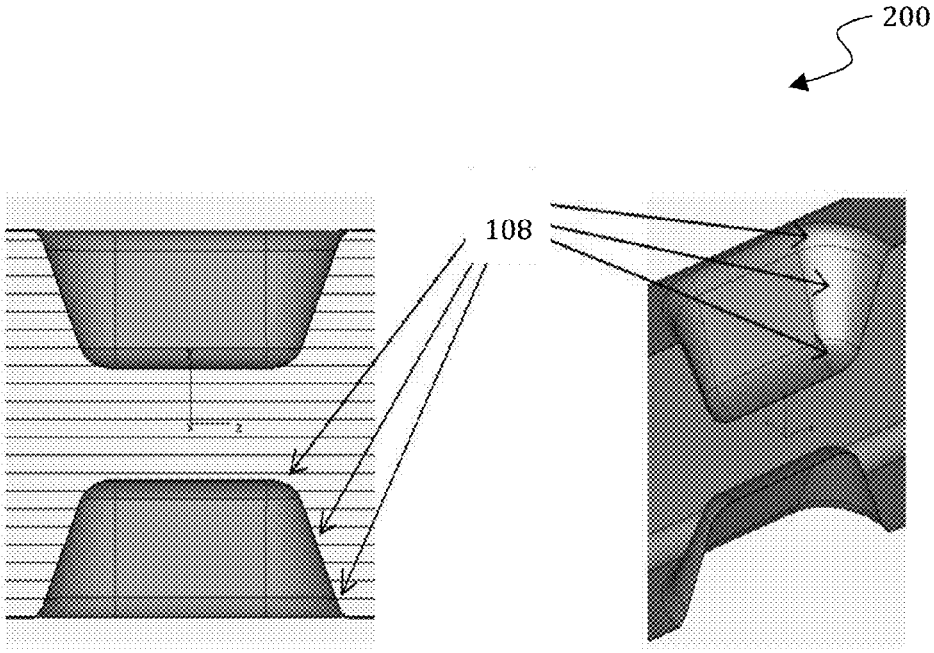
FIG. 2 depicts a diagram of the geometry of a medium cell in accordance with the disclosed embodiments.

As shown in FIG. 2, the form of the electrode may be a chain of conjugated elliptical surfaces 108 for optimal distribution of the electric and magnetic field components. The geometry of a medium cell 200 is illustrated in FIG. 2.

Figure 3:
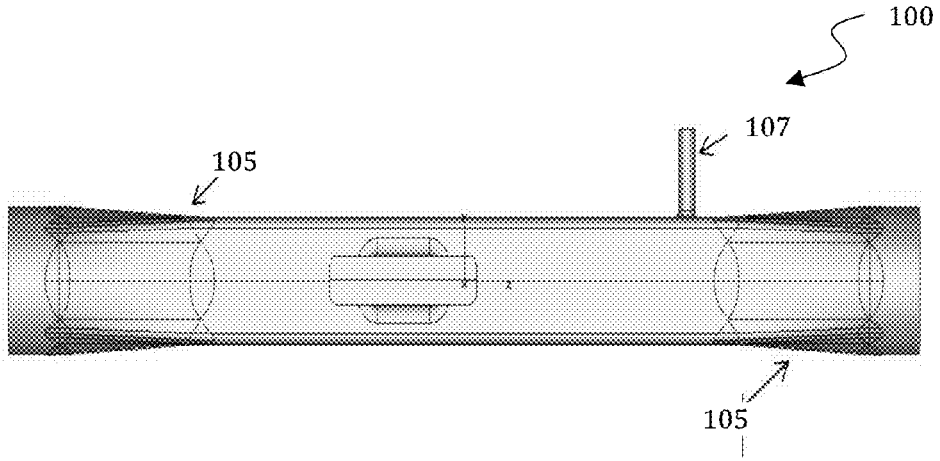
FIG. 3 depicts a side view of a deflecting superconducting cavity in accordance with an embodiment of the invention.

A side view of the cavity is shown in FIG. 3. This view exemplifies transitions 105, which are preferably smooth.

Figure 4:
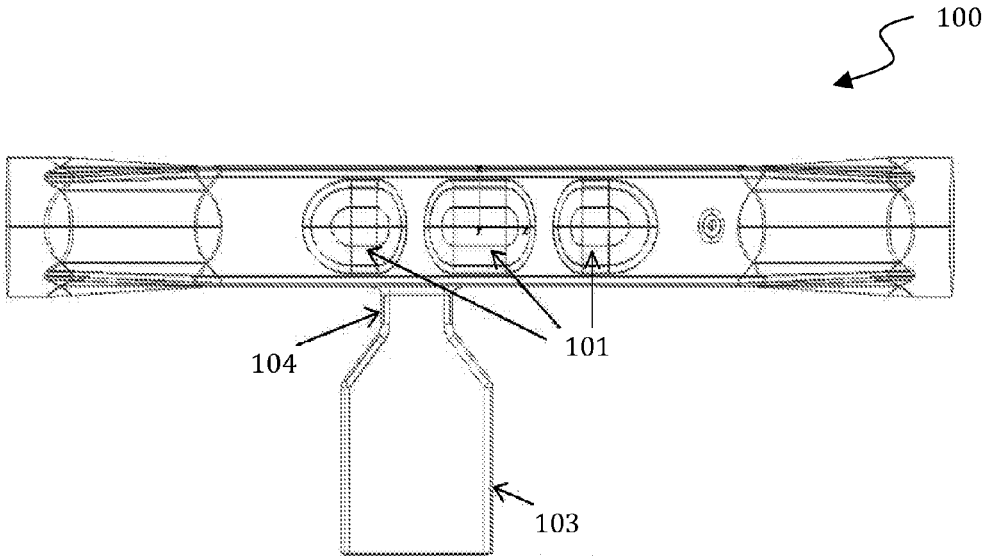
FIG. 4 depicts a top down view of a deflecting superconducting cavity in accordance with another embodiment of the invention.

FIG. 4 illustrates a top down view of the apparatus 100. In this view, each electrode 101 is visible. It is noteworthy that the shapes of the electrodes 101 may differ, as shown in FIG. 4. The shapes may be chosen according to the relative location of each of the electrodes 101. FIG. 4 also illustrates capacitive diaphragm 104 integrating rectangular waveguide 103 which provides damping of trapped modes.

Figure 5:
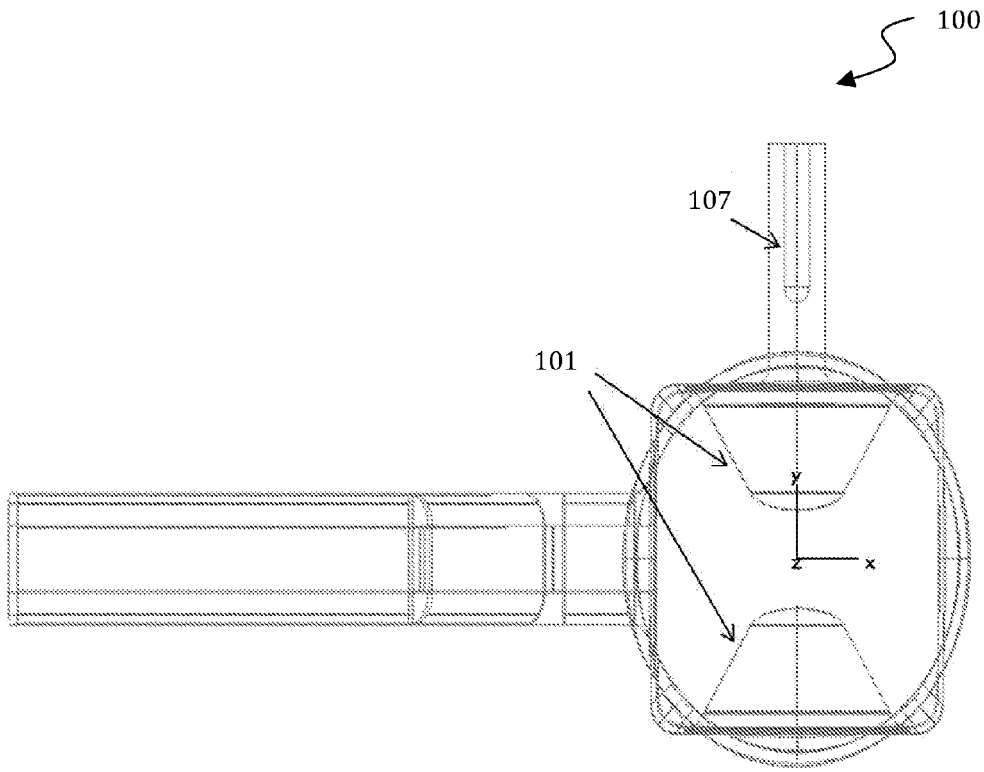
FIG. 5 depicts a front view of a deflecting superconducting cavity in accordance with an embodiment of the invention.

FIG. 5 illustrates a front projection of the apparatus 100 in accordance with the disclosed embodiments. This view provides a perspective through waveguide 102 of the void through the waveguide 102, which is the location of beam deflection. A beam of charged particles may directly enter the waveguide 102 at the elevation illustrated in FIG. 5. Electrodes 101 are shown protruding into waveguide 102 in accordance with a preferred embodiment.

Returning to FIG. 1 the cavity 100 can consist of two or more pairs of electrodes 101 formed in a waveguide 102. The waveguide 102 is connected to a vacuum beam line 106 by a smooth transition 105 providing a freely radiating and damping of beam excited HOMs.

The particular design of the transition 105 illustrated in FIG. 1 has a rounded shape matched to the design of a vacuum chamber in the actual section of the APS circular accelerator. It should be appreciated that in other embodiments the transition 105 geometry can similarly be matched to the design of the associated vacuum chamber being used in the specific application.

A broadband coaxial antenna 107 is used as an EM-field pick-up probe. A rectangular waveguide 103 is integrated to provide sufficient damping of trapped modes (see for example Table 2 below) not propagating to the beam line(s).

As a part of the embodiments disclosed herein, the waveguide 102 can also be used for feeding the cavity 100 with RF power at the operating mode. Power may be supplied by any known means. For example, a QMiR can provide continuous RF power depending on actual beam parameters. The waveguide 102 is also shifted with respect to the inter-cell boundary in order to destroy symmetry and provide an adequately high-Q coupling of operating mode with an external RF source. This reduces RF power requirements and operation costs.

A capacitive diaphragm 104 is used to control the power coupling ratio and maintain the low surface magnetic field. In one embodiment, the capacitive diaphragm 104 has rounded edges.

Figure 7A:
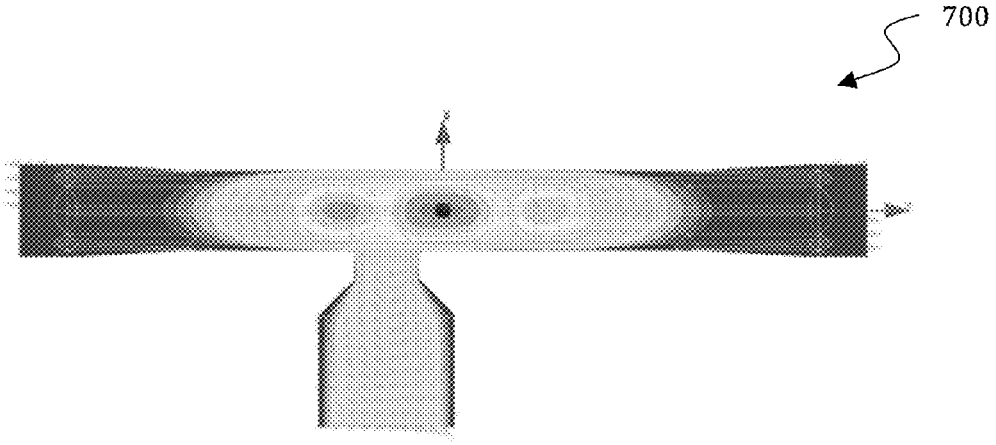
FIG. 7A depicts a graphical representation of damping low order dipole modes for the TE100 mode in accordance with another embodiment of the invention.
Figure 7B:
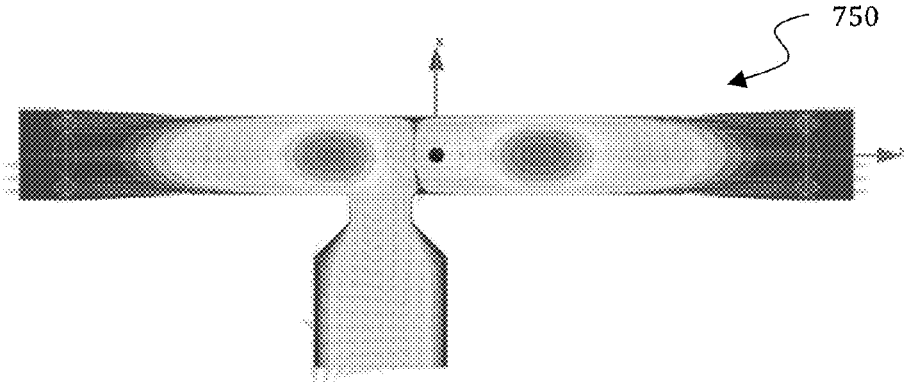
FIG. 7B depicts a graphical representation of damping low order dipole modes for the TE101 mode in accordance with another embodiment of the invention.

Damping of the low frequency trapped mode is illustrated in FIGS. 7A and 7B. Specifically, FIG. 7A illustrates a graphical representation 700 of damping of low order dipole mode TE100 through a power coupler. FIG. 7B illustrates a graphical representation 750 of damping of low order dipole mode TE101 through a power coupler.

In accordance with features of the present embodiment, the pairs of electrodes create a trapped dipole mode inside the waveguide 102. Transverse components of electric and magnetic fields in the cavity 100 deflect the beam and produce a vertical kick or crabbing of the charged particles in the particle beam.

Figure 6A:
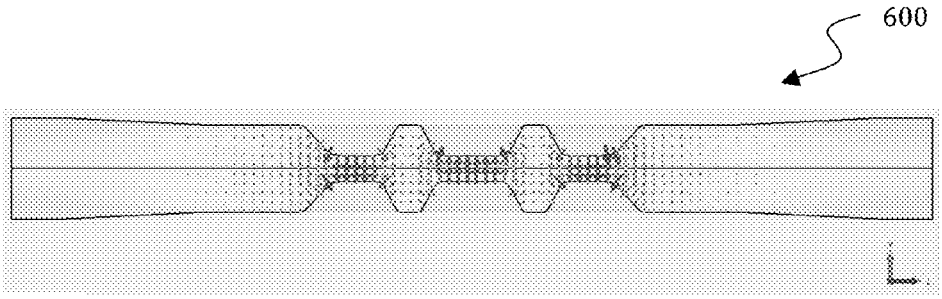
FIG. 6A depicts a graphical representation of the vector electric field of the 2815 MHz operating dipole mode in accordance with an embodiment of the invention.
Figure 6B:
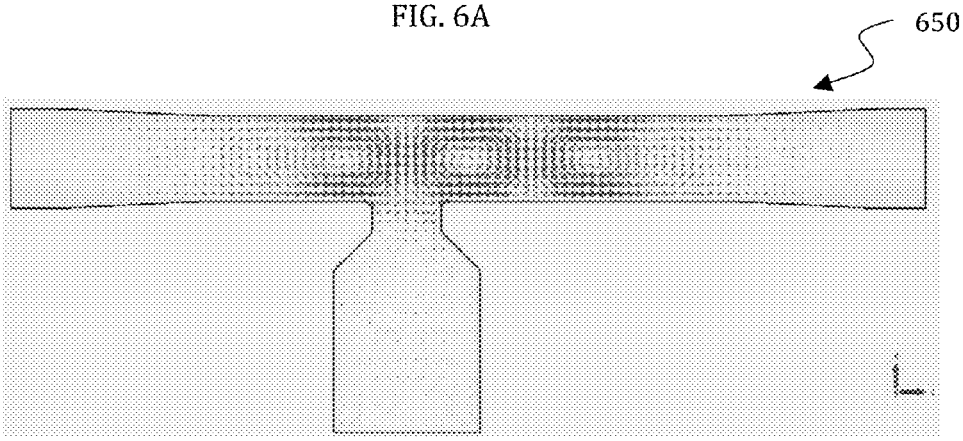
FIG. 6B depicts a graphical representation of the vector magnetic field of the 2815 MHz operating dipole mode in accordance with an embodiment of the invention.

FIG. 6A provides a diagram 600 of the vectors of an electric field in the vertical plain inside the cavity. Similarly, FIG. 6B shows a diagram 650 of the vectors of a magnetic field in the horizontal plain in the cavity. This is indicative of the coupling mechanism of the cavity operating mode and the external waveguide transmission line. The vertical kick is defined as the real part of the voltage integrated along the beam trajectory:

$$V_y = \mathrm{Re}\int_0^L (E_y + Z_0 H_x) * e^{ikz}\, dz, \tag{1}$$

wherein L is the cavity length equal to distance between beam line ports, $E_y$ and $H_x$ are transverse electric and magnetic field components, $Z_0$ is the impedance of the vacuum, and z is a longitudinal coordinate along the cavity axis.

The three protrusions have specially optimized shapes in order to keep the maximum surface electric and magnetic fields below approximately 55 MV/m and 75 mT, respectively, while maintaining the vertical kick at approximately the 2 MV level. Experimental data suggests that SRF cavities can reliably operate if the surface electric field is below 75 MV/m and surface magnetic field is less than 100 mT. Considering this experimentally determined metric, the present design provides a good safety margin.

Figure 8:
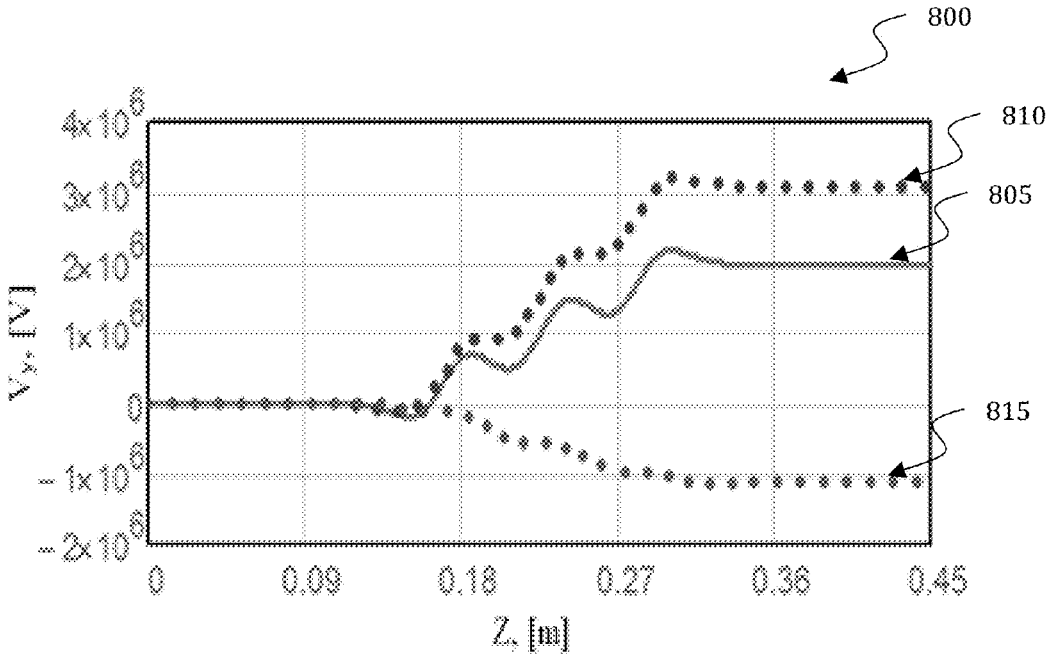
FIG. 8 depicts a chart of the vertical kick accumulation along the cavity axis in accordance with embodiments of the invention.

FIG. 8 is a chart 800, which illustrates that the vertical kick is built along the cavity axis. In particular, trace 805 shows the overall kick, trace 810 shows the electric kick, and trace 815 shows the magnetic kick. Table 1 contains the most essential operating mode parameters including the transverse shunt impedance defined as $(R/Q)_y = V_y^2/\omega W$, where ω is the mode circular frequency and W is the electromagnetic energy stored in the cavity, in accordance with embodiments of the invention. It should be mentioned that the transverse shunt impedance of a proposed three-cell deflecting cavity is above 1 kΩ, which is remarkably high compared to traditional single cell designs based on TM11 or TE11 modes.

TABLE 1

| Exemplary Deflecting mode operating parameters | |
|---|---|
| Frequency | 2815 MHz |
| Vertical kick | 2 MV |
| Maximum surface electric field | <55 MV/m |
| Maximum surface magnetic | <75 mT |
| Transverse shunt impedance | 1040 Ω |
| Stored energy | 0.23 W |

The lowest frequency eigenmode of the cavity 100 is the dipole deflecting mode. Besides the operational deflecting mode, there are two other "same-order" deflecting modes whose frequencies are slightly lower. A fundamental coupler waveguide 103 associated with cavity 100 is shown in FIG. 1. The fundamental coupler waveguide 103 is used to suppress these modes and is, therefore, intentionally shifted from the cavity 100 center in order to provide external coupling for the operating mode and to dampen lower frequency dipole modes simultaneously. Table 2 shows calculated transverse impedances and quality factors for these modes in accordance with the embodiments disclosed herein. The largest transverse impedance is 1.9 MΩ/m, which is below the maximum values defined as 3.9 MΩ/m. The beam pipe cutoff frequency for the transverse TE11 mode is 3.6 GHz and, thus, all higher frequency dipole modes freely propagate out of the cavity.

TABLE 2

| Transverse Dipole Modes | | | |
|---|---|---|---|
| Freq., [GHz] | (R/Q)t, [Ω] | Qext | Rt [MΩ/m] |
| 2.476 | 0.03 | 2400 | 3e−3 |
| 2.675 | 5.0 | 6800 | 1.9 |

The cavity spectrum for monopole modes is sparse and contains four modes below the beam pipe cutoff frequency of 4.7 GHz and two trapped modes above. It should be appreciated that the present invention is not limited to two trapped modes. There is a power limit on RF power loss for High Order Modes. The lower number of trapped modes indicates less probability of the beam being in resonance with HOM. Thus, the beam loses less energy. Parameters of these modes are shown in Table 3. All monopole modes are well separated from the operating mode and have relatively low R/Q and loaded Q values. The largest calculated longitudinal impedance is 0.26 MΩ·GHz, thus, no multi-bunch instability results because the magnitude of the HOM impedances listed above are below the maximum values defined as 0.44 MΩ·GHz. It should be noted that this maximum value is defined by the design of the accelerator and is not a limit on the present invention.

TABLE 3

| Monopole Modes. | | | |
|---|---|---|---|
| Freq., [GHz] | R/Q, [Ω] | Qext | R * F, [MΩ * GHz] |
| 4.304 | 1.3 | 55 | 3e−4 |
| 4.409 | 39 | 530 | 0.09 |
| 4.471 | 37 | 400 | 0.07 |

TABLE 3-continued

| Monopole Modes. | | | |
|---|---|---|---|
| Freq., [GHz] | R/Q, [Ω] | Qext | R * F, [MΩ * GHz] |
| 4.530 | 0.35 | 5900 | 8e−3 |
| 5.080 | 132 | 390 | 0.26 |
| 5.114 | 39 | 108 | 0.02 |

Figure 9:
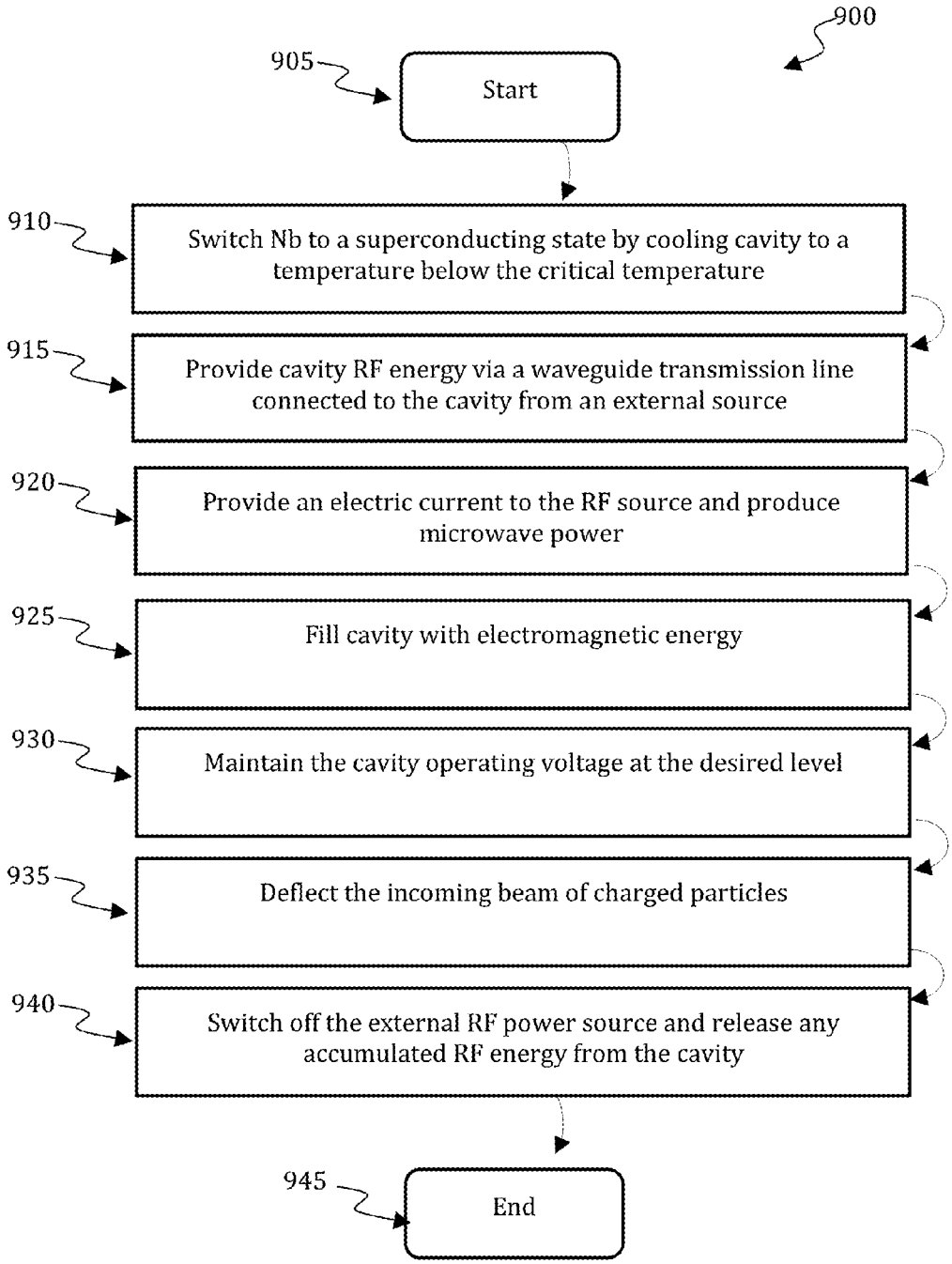
FIG. 9 depicts a flow chart of steps for deflecting a beam associated with the systems and methods disclosed herein, in accordance with an embodiment of the invention.

A method for deflecting a beam, or charged particles in a beam, via operation of the proposed deflecting cavity is described in the flow chart 900 shown in FIG. 9. The method starts at step 905.

The method can begin by switching the Nb to a superconducting state by cooling down the cavity below a critical temperature at step 910. Next at step 915, a source of external RF energy can be supplied to the cavity via a waveguide transmission line. An electrical current can be provided to the RF source in order to produce microwave power, as shown by step 920.

The cavity is then filled with electromagnetic energy at step 925. The cavity can be maintained at an operating voltage at step 930 by controlling its resonant frequencies and RF coupling. A beam of charged particles is then introduced to the cavity. The charged particles in the cavity are deflected by the electromagnetic field in the cavity, as shown at step 935. After the particles have been introduced, the external RF source can be switched off at step 940 and the accumulated RF energy can be released from the cavity. The method ends at step 945.

The embodiments of the deflecting cavity provided herein have low parasitic HOM RF losses and a higher beam instability threshold due to HOM excitation, which is critical for high beam current operation. The embodiments avoid complicated HOM couplers and create a higher operating gradient at the same time, thereby producing a more compact cryomodule design. The embodiments also significantly reduce the overall consumption of liquid helium. The superconducting QMiR cavity may be beneficially operated in the Short Pulse X-ray (SPX) upgrade of the Argonne APS facility and may also be widely used in conjunction with other Synchrotron Radiation (SR) sources.

Based on the foregoing, it can be appreciated that a number of embodiments, preferred and alternative, are disclosed herein. For example, in one embodiment, an RF cavity for beam deflection comprises: a wave guide comprising an open ended resonator volume configured to operate as a trapped dipole mode; a plurality of cells configured to provide a high operating gradient: and at least two pairs of protrusions configured for lowering surface electric and magnetic fields. In another embodiment, the RF cavity comprises a compact superconducting RF cavity. The RF cavity further comprises high order monopole modes wherein the higher order monopole modes are damped by radiating to open beam line pipes.

In another embodiment, the RF cavity further comprises a main power coupler positioned to optimize necessary coupling for an operating mode and damping lower dipole modes simultaneously. The least two pairs of protrusions are elliptical shaped.

In yet another embodiment, the plurality of cells comprises electrodes formed in opposite walls of the resonator. The RF cavity further comprises a beam of particles configured to pass through the open ended resonator.

In another embodiment, the RF cavity further comprises a broadband coaxial antenna configured as an EM-field pick-up probe. A capacitive diaphragm may also be configured to control a power coupling ratio associated with the RF cavity.

In an alternative embodiment, a system for beam deflection comprises a compact superconducting RF cavity further comprising: a waveguide comprising an open ended resonator volume configured to operate as a trapped dipole mode; a plurality of cells are configured to provide a high operating gradient; at least two pairs of protrusions are configured for lowering surface electric and magnetic fields; and a main power coupler is positioned to optimize necessary coupling for an operating mode and damping lower dipole modes simultaneously.

The system further comprises high order monopole modes wherein the higher order monopole modes are damped by radiating to open beam line pipes. The at least two pairs of protrusions are elliptical shaped and the plurality of cells comprise electrodes formed in opposite walls of the resonator.

The system further comprises a broadband coaxial antenna configured as an EM-field pick-up probe and a capacitive diaphragm configured to control a power coupling ratio associated with the RF cavity.

In an alternative embodiment, a method of beam deflection comprises forming a compact superconducting RF cavity in a beam line; connecting the compact superconducting RF cavity to an external energy source; filling the compact superconducting RF cavity with electromagnetic energy; and deflecting incoming charged particles.

The method may further comprise providing electrical current to produce microwave power and maintaining the compact superconducting RF cavity at an operating voltage.

In one embodiment, maintaining the compact superconducting RF cavity at an operating voltage further comprises controlling a resonance frequency and an RF coupling of the compact superconducting RF cavity.

The method may further comprise releasing accumulated RF energy in the compact superconducting RF cavity.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. An RF cavity for beam deflection comprising:

a waveguide comprising an open ended resonator volume configured to operate as a trapped dipole mode;

a plurality of cells configured to provide a high operating gradient; and at least two pairs of protrusions configured for lowering surface electric and magnetic fields.

2. The RF cavity of claim 1 wherein said RF cavity comprises a compact superconducting RF cavity.

3. The RF cavity of claim 1 further comprising high order monopole modes wherein said higher order monopole modes are damped by radiating to open beam line pipes.

4. The RF cavity of claim 1 further comprising:

a main power coupler positioned to optimize necessary coupling for an operating mode and damping lower dipole modes simultaneously.

5. The RF cavity of claim 1 wherein said at least two pairs of protrusions are elliptical shaped.

6. The RF cavity of claim 1 wherein said plurality of cells comprise electrodes formed in opposite walls of said resonator.

7. The RF cavity of claim 1 further corn pr ng a beam of particles configured to pass through said open ended resonator.

8. The RF cavity of claim 1 further comprising:

a broadband coaxial antenna configured as an EM-field pick-up probe.

9. The RF cavity of claim 1 further comprising a capacitive diaphragm configured to control a power coupling ratio associated with said RF cavity.

10. A system for beam deflection comprising:

a compact superconducting RF cavity further comprising:

a waveguide comprising an open ended resonator volume configured to operate as a trapped dipole mode;

a plurality of cells configured to provide a high operating gradient;

at least two pairs of protrusions configured for lowering surface electric and magnetic fields; and a main power coupler positioned to optimize necessary coupling for an operating mode and damping lower dipole modes simultaneously.

11. The system of claim 10 further comprising high order monopole modes wherein said higher order monopole modes are damped by radiating to open beam line pipes.

12. The system of claim 10 wherein said at least two pairs of protrusions are elliptical shaped.

13. The system of claim 10 wherein said plurality of cells comprise electrodes formed in opposite walls of said resonator.

14. The system of, claim 10 further comprising:

a broadband coaxial antenna configured as an EM-field pick-up probe.

15. The system of claim 10 further comprising a capacitive diaphragm configured to control a power coupling ratio associated with said RF cavity.

* * * * *